United States Patent [19]

Suttles

[11] 4,195,430

[45] Apr. 1, 1980

[54] DISPLAY WITH MOVABLE INDICIA

[75] Inventor: James M. Suttles, Elberton, Ga.

[73] Assignee: Hopeman Brothers, Inc., New York, N.Y.

[21] Appl. No.: 843,276

[22] Filed: Oct. 18, 1977

[51] Int. Cl.[2] ..... G09F 11/29

[52] U.S. Cl. ..... 40/518; 40/117; 40/609

[58] Field of Search ..... 40/518, 471, 375, 489, 40/490, 109, 117, 609, 624, 618, 515, 16, 4; 248/300

[56] References Cited

U.S. PATENT DOCUMENTS

| | | | |
|---|---|---|---|
| 1,664,511 | 4/1928 | Isbell | 40/518 |
| 1,752,509 | 4/1930 | Singer | 40/518 |
| 1,788,468 | 1/1931 | Mentink | 40/618 |
| 1,965,118 | 7/1934 | Higgins | 40/618 |
| 2,118,696 | 5/1938 | Bonetti | 40/518 |
| 4,090,315 | 5/1978 | Brown, Jr. et al. | 40/518 |

*Primary Examiner*—John F. Pitrelli
*Assistant Examiner*—G. Lee Skillington
*Attorney, Agent, or Firm*—George A. Smith, Jr.

[57] ABSTRACT

A support for use in conjunction with self-coiling indicia-carrying sheets in a movable indicia display utilizes two identical backing members, and two identical end members, a total of only four parts. Sheet metal is used, and roll retainers are integrally formed on the backing members, as are intermediate edge guides for the indicia-carrying sheets. The end members serve as edge guides, and also provide support for the ends of the roll retainers. The entire assembly is fastener-free, cooperating tabs and slots being used to secure the parts together. In a modified version, each end member is permanently secured to one of the backing members so that the support comprises only two separable parts, which are identical to each other. In another modification, adapted to be viewed from only one side, only one backing member is used.

9 Claims, 10 Drawing Figures

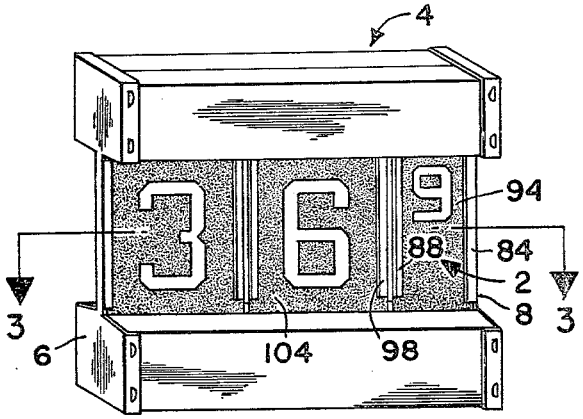
FIG. 2.
FIG. 1.
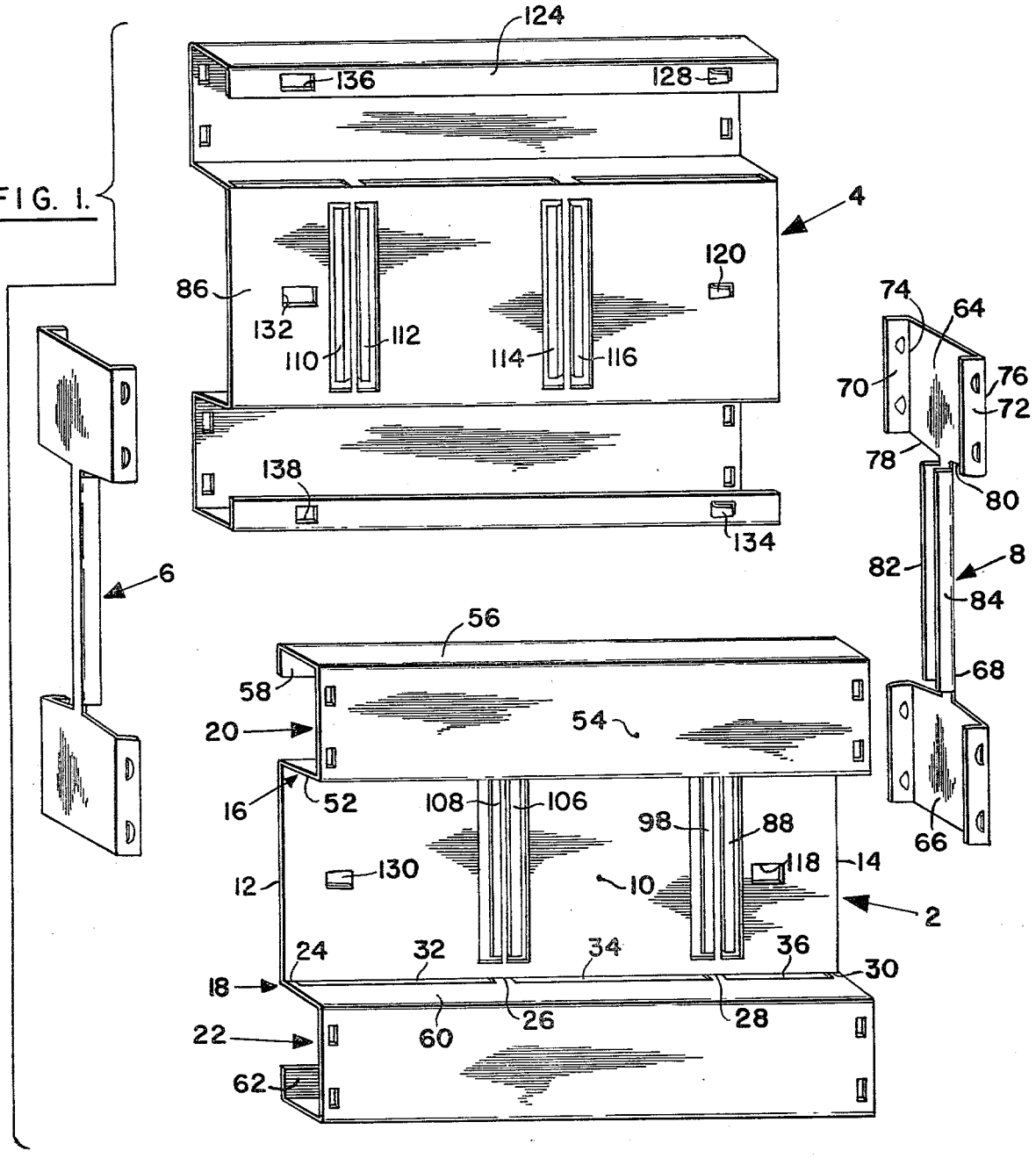

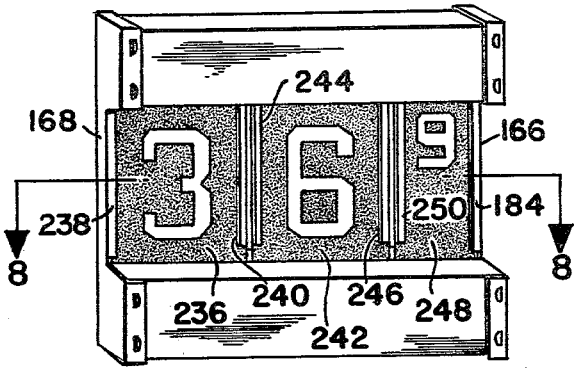
FIG. 7.
FIG. 6.
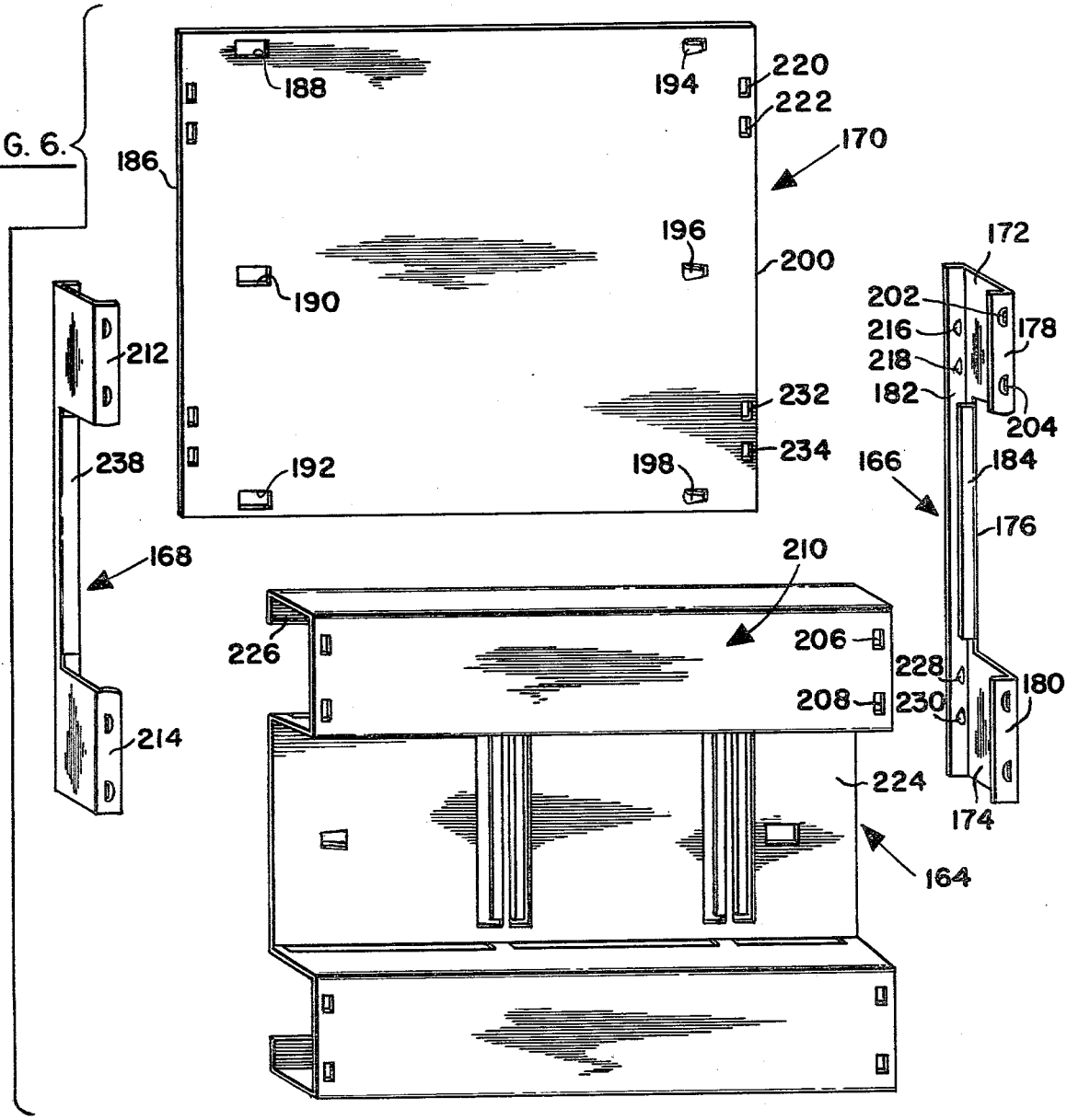

DISPLAY WITH MOVABLE INDICIA

BRIEF SUMMARY OF THE INVENTION

This invention relates to movable indicia displays, and particularly to a simplified support structure for displays utilizing self-coiling indicia-carrying sheets. The invention is particularly useful for displaying prices of gasoline in service stations, but may be used in various other applications, for example flight number signs in airport baggage claim areas, signs used in announcing airline, railroad or bus departures, safety signs in industrial plants (i.e. signs displaying the number of days since the last lost-time accident), calendars, and price displays in "fast-food" restaurants. The invention is especially useful where information is to be displayed on both sides of a signboard, but a number of important features of the invention have utility in single-sided displays as well.

Polyester sheets such as Mylar (polyethylene terephthalate) can be heat-treated to produce tightly self-coiling rolls. These rolls provide an ideal indicia-carrying material for movable-indicia displays, as their self-coiling characteristic eliminates the need for take-up reels, cranks and other feeding mechanisms. A polyester sheet can be arranged so that rolls are formed at both ends, with the section extending between the rolls providing the display. In order to change the information displayed, it is only necessary to push on the section between the rolls manually, causing the sheet to feed from one roll to the other. Where multiple-digit numerical information is to be displayed, any number of sheets can be arranged in side-by-side relationship, each sheet displaying only one digit at any particular time.

In displays of this type, it is necessary to provide a support for the polyester rolls, and also to provide guidance either for the sections of the sheets extending between the rolls, or for the rolls themselves. One such support system is described in the copending application of Asa V. Brown, Jr. and James Marshall Suttles, Ser. No. 780,677, filed Mar. 23, 1977, now U.S. Pat. No. 4,090,315, dated May 23, 1978. The system utilizes a series of identical sheet metal panels having edge guides formed therein.

The present invention constitutes a substantial simplification over what is described in the Brown and Suttles application, in that it uses a smaller number of parts, and is easier to assemble.

In a preferred support in accordance with the invention, a sheet metal member is provided, having a substantially rectangular planar face. Guide means, integrally formed on the face, extend in perpendicular relation to two opposite edges thereof and comprise a pair of elongated rectangular punched out sheet metal sections lying in a plane spaced from the face. These sections have elongated openings facing in opposite directions and adapted to receive the adjacent edges of a pair of side-by-side indicia-carrying sheets.

The sheet metal member also includes roll retaining means integrally formed on two of its opposite edges. The roll retaining means are connected to the face at least in part by means of narrow strips adjacent the ends of said guide means. These strips provide slots, along the two opposite edges between the edges and the roll retaining means, for receiving the indicia-carrying sheets.

In a version of the support adapted to be viewed from both sides, first and second substantially identical sheet metal backing members are provided. These members are secured together in back-to-back relationship, preferably by cooperating tabs and slots. Four roll retainers are used, two being on each backing member.

A pair of end members are provided, and each end member is secured to all four of the roll retaining means. At least one of said end members has means, extending between its opposite ends, forming guide channels for the edges of a pair of indicia-carrying sheets on opposite sides of the support.

The principal object of the invention is to provide a movable indicia display which is relatively inexpensive to manufacture and which is easy to assemble. These advantages arise primarily by virtue of the fact that the invention makes possible the use of a very small number of parts, and the fact that the invention permits certain parts to be identical to each other.

It is also an object of the invention to provide a display which is both high in strength and at the same time light in weight. These advantages arise primarily by virtue of the fact that the backing panels and roll retainers are integrally formed from a single sheet of metal, by virtue of the particular manner in which the roll retainers are attached to the backing panels, by virtue of the reinforcement of the roll retainers by the end members, and also by virtue of the fact that the end members also function as edge guides for the indicia-carrying sheets.

Numerous other objects and advantages will become apparent from the following detailed description.

BRIEF DESCRIPTION OF THE DRAWINGS

FIG. 1 is an exploded view showing the four elements of a support in accordance with the invention, adapted to be viewed from both sides;

FIG. 2 is an oblique perspective view of the support of FIG. 1;

FIG. 6 is an exploded view of an alternative support in accordance with the invention, adapted to be viewed from only one side;

FIG. 7 is an oblique perspective view of the support of FIG. 6 in assembled form;

DETAILED DESCRIPTION

Figure 3:
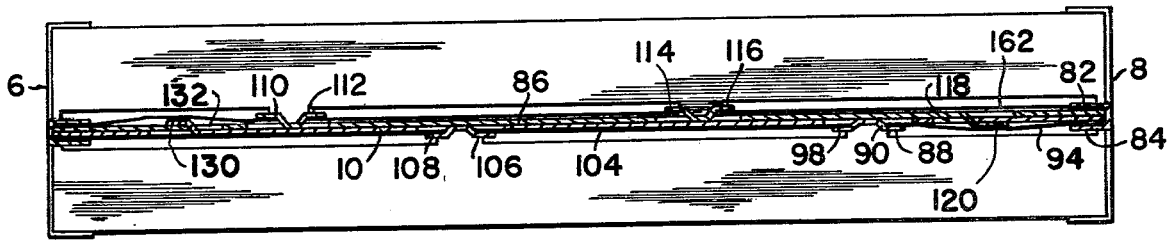
FIG. 3 is a horizontal section taken on the plane 3—3 of FIG. 2.

The version of the display adapted to be viewed from both sides, as shown in FIG. 1 comprises two identical backing members 2 and 4, and two identical end members 6 and 8, for a total of only four parts.

Backing member 2 is formed from a single sheet of metal and comprises a rectangular panel 10 having a substantially planar face bounded by opposite vertical edges 12 and 14, and by opposite horizontal edges 16 and 18, the latter being defined in part by slots, and in part by folds in narrow strips which interconnect upper and lower roll retaining members 20 and 22 with rectangular panel 10. Thus, roll retaining member 22 is unitary with integrally connected to panel 10 by a series of narrow strips 24, 26, 28 and 30. An elongated, narrow slot 32 is formed between panel 10 and member 22, and extends from strip 24 to strip 26. A similar slot 34 extends from strip 26 to 28, and a similar, but shorter, slot 36 extends from strip 28 to 30. Roll retainer 20 is similarly connected to the upper edge 18 of panel 10 by means of a series of similar narrow strips (not shown in FIG. 1), and slots, similar to slots 32, 34 and 36, are provided between these strips.

Roll retainer 20 is formed by a series of folds providing a series of rectangular sections 52, 54, 56 and 58. A first section 52 extends forwardly, and preferably both forwardly and upwardly from the front face of panel 10 at an angle of about 105°. Section 54 extends vertically from the upper edge of section 52. Section 56 extends rearwardly in the horizontal direction from section 54, and a narrow flange section 58 extends downwardly from the rear edge of section 56. Roll retaining member 22 is similar to retaining member 20, and extends downwardly from lower edge 18 of panel 10. These roll retainers, as will be apparent, form partial enclosures for indicia-carrying rolls located above and below rectangular panel 10.

It should be noted that section 52 of retaining member 20 and corresponding section 60 of member 22 are integrally connected to panel 10 through the narrow strips and that flange section 58 and its corresponding flange section 62 on the lower retaining member are relatively narrow, and are connected to panel 10 only indirectly through the other rectangular sections of the respective retaining members. The absence of direct interconnections between flange sections 58 and 62 and panel 10 gives rise to a substantial reduction in weight and saving of material. The resulting open space behind the roll retainers also simplifies the installation of the indicia-carrying rolls while at the same time permitting the panel and roll retaining members to be integrally formed from a single sheet of metal.

The fact that the roll retaining members are connected to panel 10 through a limited number of narrow strips gives rise to an inherent weakness in the structure of the backing member. However end members 6 and 8 cooperate with backing members 2 and 4, and the backing members cooperate with each other, in such a way as to reinforce the connection between the panels and the retaining members. Consequently the resulting assembly is both rigid and quite strong.

End member 8, as shown in FIG. 1, is formed from a single sheet of metal and is symmetrical both vertically and horizontally. It comprises identical upper and lower flat sections 64 and 66 connected to each other by a strip 68. Section 64 has two rectangular flanges 70 and 72 extending in perpendicular relation to section 64 and parallel to each other in the same direction from vertical edges 74 and 76. Lower edges 78 and 80 taper toward each other and meet the respective vertical edges of strip 68 at 105° angles for conformity with the end openings of the roll retainers. Strip 68 also has two parallel elongated rectangular flanges 82 and 84 extending from its vertical edges in the same direction as flanges 70 and 72. Flanges 82 and 84 form an elongated channel, and are spaced from each other by a distance such that they are able to act as edge guides for indicia-carrying material when the support is fully assembled.

Backing members 2 and 4 and end members 6 and 8 are assembled as illustrated in FIG. 2, with the roll retaining members cooperating with the end members to provide substantially complete enclosures for the indicia-carrying rolls. Each sheet of indicia-carrying material extends from a roll in the upper enclosure, through a slot at the upper edge of a backing panel (corresponding to panel 10), then through a slot at the lower end of the backing panel to another roll within the lower enclosure.

Figure 4:
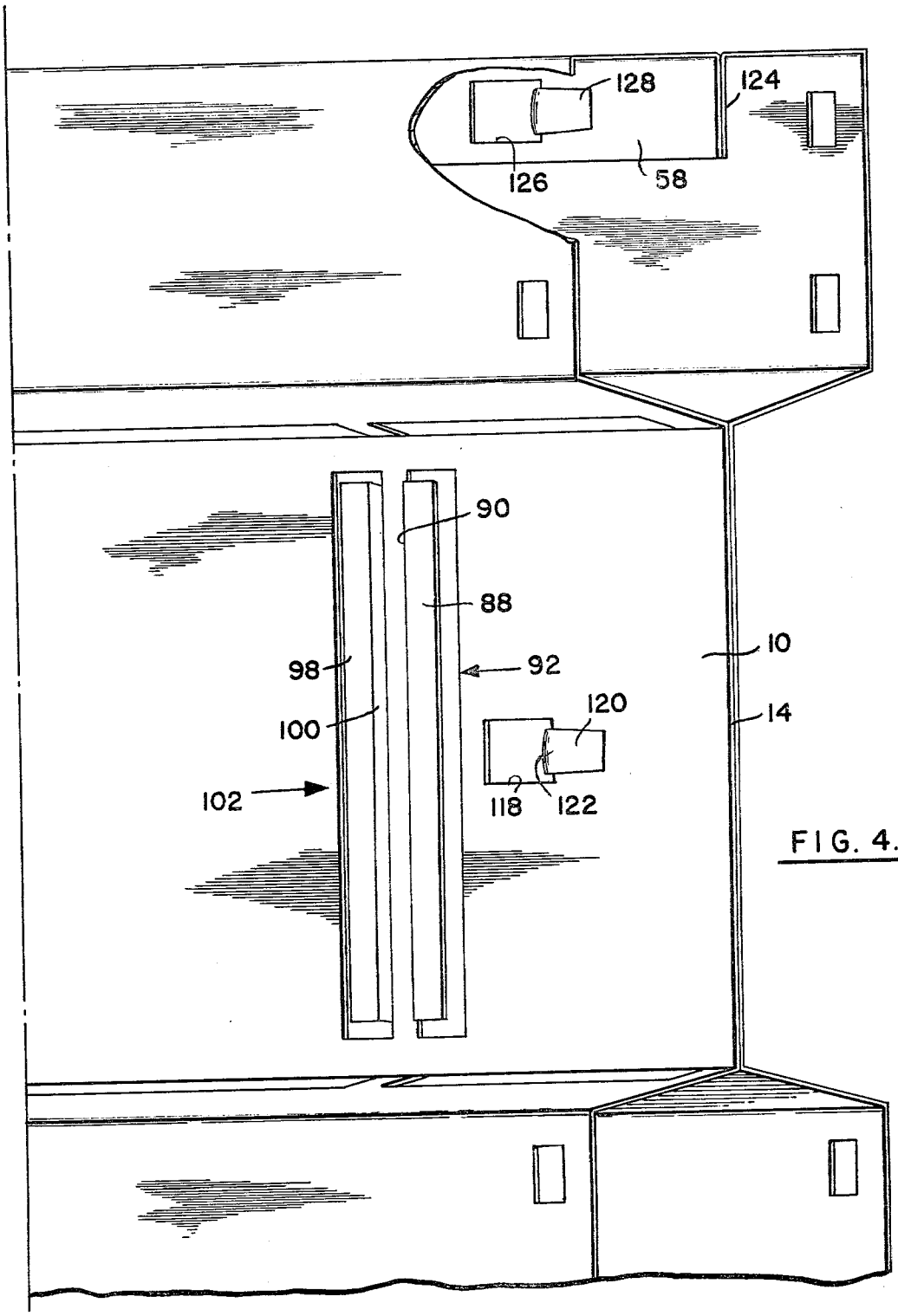
FIG. 4 is an oblique perspective view of the right-hand upper portion of the support, with the end member removed, and partially cut away to show the interlocking relationship between the two backing members.

The intermediate vertical edges of the series of indicia-carrying sheets are guided by elongated, rectangular sheet metal guide sections punched out of panel 10 of backing member 2, and its corresponding panel 86 in backing member 4. As shown in FIGS. 1, 2, 3 and 4, rectangular guide section 88 is punched out of panel 10. Guide section 88, as best seen in FIG. 4, lies in a plane spaced by a short distance from the face of panel 10, and is connected to panel 10 by a web 90 along its left-hand edge so that an elongated opening 92 is formed which faces toward the right and is adapted to receive the left-hand edge of indicia-carrying sheet 94 (FIGS. 2, 3). The right-hand edge of sheet 94 is guided by flange 84 (FIGS. 2, 3).

A similar punched out guide section is formed at 98 alongside guide section 88, as best shown in FIG. 4. Guide section 98 is connected to panel 10 through web 100, and has an elongated opening 102 adapted to receive the right-hand edge of sheet 104 (FIGS. 2, 3).

As shown in FIG. 3, similar punched out guide sections are provided at 106 and 108 in panel 10 and at 110, 112, 114 and 116 in panel 86. In the case of a gasoline price display the punched out guide sections are desirably positioned on the panels, as shown in FIG. 3, to accommodate two wide indicia-carrying sheets and a relatively narrow sheet on each side of the display.

FIG. 4 illustrates the manner in which backing members 2 and 4 are secured together in back-to-back relationship by cooperating tabs and slots.

A rectangular slot 118 is formed in panel 10, near its vertical edge 14. A tab 120 is punched out of panel 86 and secured thereto by a connecting web 122 along the left-hand edge of the tab. This tab is generally parallel to the surfaces of panel 86 and spaced from the rear surface (the surface of panel 86 seen in FIG. 1) by approximately the width of panel 10. Web 122 extends through slot 118, and tab 120 extends toward edge 12 and overlies the face of panel 10 so that panels 10 and 86 are secured together. The horizontal dimension of slot 118 is at least slightly larger than that of tab 120, so that the tab can enter the slot. A tab 130, shown in FIG. 1 cooperates with slot 132 in a similar manner.

A similar connection (FIG. 4) is made between flanges 58 and 124 by the cooperation of slot 126 in flange 58 with tab 128 on flange 124. The tab extends in the same direction as does tab 120, in order to allow the two backing members to be secured together simply by sliding one relative to the other in a horizontal direction. Similar connections are made between tab 134, shown in FIG. 1, and a slot (not shown) in flange 62, and between slots 136 and 138 and corresponding tabs in flanges 58 and 62.

As backing members 2 and 4 are identical, it will be apparent that there are three tabs along the right-hand side of member 4 as shown in FIG. 1 and cooperating slots along the right-hand side of member 2. Likewise, there are three tabs along the left-hand side of member 2 and cooperating slots along the left-hand side of member 4. Each slot is of sufficient size as to receive its corresponding tab on the other member, and the slots and tabs are positioned so that members 2 and 4 can be assembled by placing the members in back-to-back relationship, causing the tabs to enter their corresponding slots, and thereafter sliding the two members relative to each other in a horizontal direction, until the vertical edges of the panels are aligned. Preferably the webs of the tabs are positioned so that, when they meet the edges of their corresponding slots, the vertical edges of the panels are aligned.

While the tabs extend in directions such that member 4 is moved toward the right and member 2 is moved toward the left during assembly, it is possible to extend the tabs in vertical directions so that members 2 and 4 are assembled by relative vertical movement, or inwardly rather than outwardly so that, in assembly, member 4 is moved toward the left and member 2 toward the right.

Figure 5:
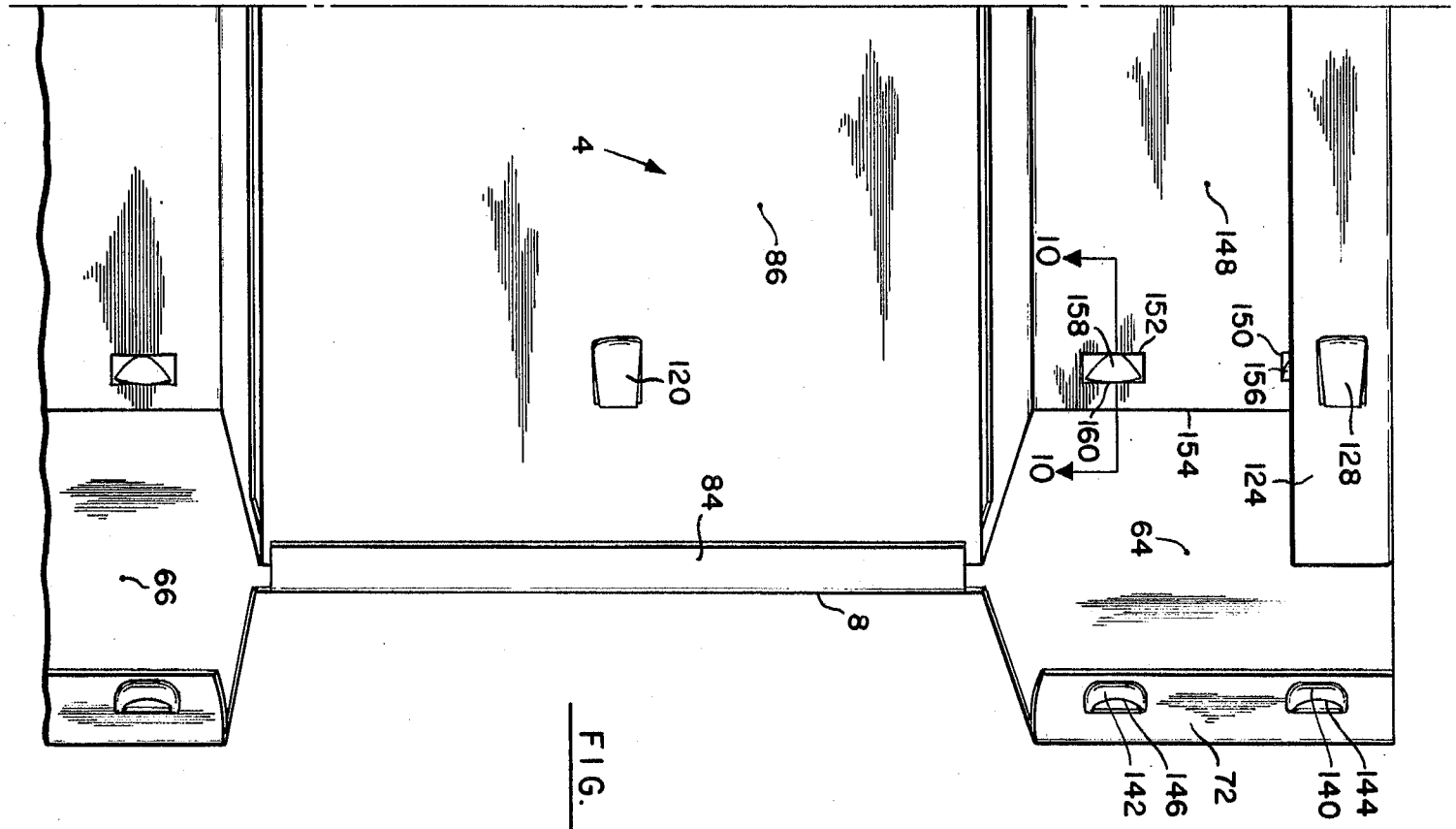
FIG. 5 is a perspective view of the support with the front backing member removed to illustrate the manner in which the end members are secured to the backing members.

FIG. 5 shows the manner in which end member 8 is secured to the backing panels. Flange 72 of the end member is provided with a pair of rounded locking projections 140 and 142, both of which protrude inwardly toward the opposite flange. Each locking projection is generally in the form of a dimple, having an edge separated from the flange in which it is formed to provide means by which the projection is enabled to engage a slot in locking relationship. Thus, projection 140 has an edge 144 which is separated from flange 72. Similarly, projection 142 has an edge 146.

Figure 10:
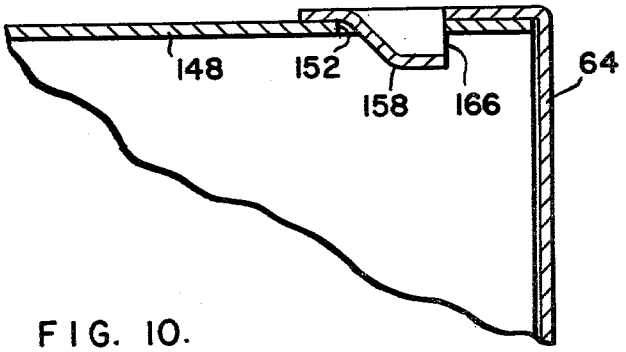
FIG. 10 is a fragmentary horizontal section taken on the plane 10—10 of FIG. 5.

Similar projections are formed in all four of the flanges of each end member corresponding to flange 72. Vertical member 148 of the upper roll retainer of backing member 4 is provided with a pair of vertically aligned slots 150 and 152 adjacent its right-hand edge 154. Slots 150 and 152 receive respectively projections 156 and 158 which extend through the slots from flange 70 (not shown in FIG. 4). As shown in FIGS. 5 and 10, the edge 160 along the right-hand side of projection 158 engages the right-hand edge of slot 152, thereby securing the end member against movement toward the right. The remaining projections of the flanges of end member 8 similarly engage slots formed in the vertical roll-retainer sections, locking the end members in place and further reinforcing the overall assembly.

Reinforcement of the roll retainers, as best seen in FIG. 1, arises by virtue of the direct interconnection of the roll retainer flanges, for example flanges 58 and 124; by virtue of the interconnection of the roll retainers of the opposite backing members through the flat sections (e.g. section 64) of the end members; and also by virtue of the interconnection of the upper and lower roll retainers on each backing member through the elongated strips (e.g. strip 68) of the end members. Consequently even though a substantial saving in weight and structural simplification are achieved at the expense of rather weak connections between the roll retainers and the rectangular panels, the ultimate assembly possesses more than adequate strength.

In the course of assembly, after backing members 2 and 4 are properly engaged with each other, the end members are pressed into position. The rounded locking projections of the end members cam their flanges outwardly, allowing the end members to be pressed into position. As soon as the separated edges of the locking projections clear the edges of their corresponding slots, the locking projections snap into the slots so that the end members are locked in place. Removal of the end members is easily accomplished by a prying action to cause the locking projections to disengage their slots.

As seen in FIG. 3, flange 84 of end member 8 provides guidance for the right-hand edge of sheet 94, and flange 82 provides similar guidance for the right-hand edge of sheet 162. Corresponding flanges on end member 6 guide the edges of the sheets at the left-hand edge of the assembly, and guidance for the remaining edges of the indicia-carrying sheets is provided by punched out guide sections 88, 98, 106, 108, 110, 112, 114 and 116.

As will be apparent from a study of FIG. 1, the two-sided support of FIG. 1 has a number of inherent advantages including, but not necessarily limited to the following.

In the first place, only four parts are required, namely backing members 2 and 4, and end members 6 and 8. No fasteners are needed, and, as the end members are identical to each other and the backing members are likewise identical to each other, manufacture of parts involves the fabrication of only two different types of sheet metal members.

A second significant advantage resides in the combined light weight and high strength of the structure, resulting in part from the manner in which the roll retainers are integrally formed with the backing panels, and the manner in which the roll retainers are reinforced. The light weight results in part from the fact that the roll retainers, individually, do not have to form complete closures for the rolls, and in part by the fact that the reinforcement provided by the end members and the cooperation of the backing members with each other permits the use of relatively light gauge sheet metal.

A third advantage in terms of lightness in weight and simplicity of structure arises from the fact that the end members serves as edge guides for the indicia-carrying sheets.

Figure 8:
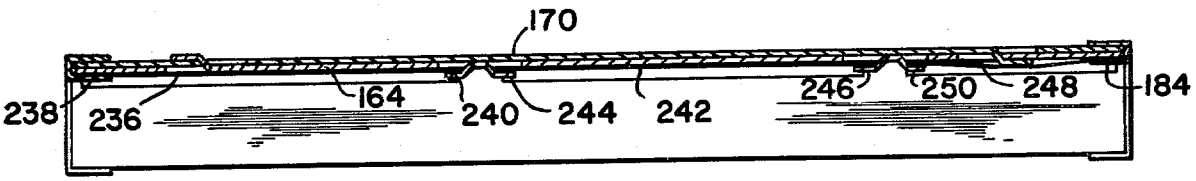
FIG. 8 is a horizontal section taken on the plane 8—8 of FIG. 7.

The modified version of the sign shown in FIGS. 6, 7 and 8, comprises a backing member 164, identical to backing members 2 and 4 (FIG. 1), a pair of end members 166 and 168, and a panel 170.

The end members are similar to those shown in FIG. 1, but are not symmetrical about a vertical plane. End member 166 comprises upper and lower flat sections 172 and 174, which are connected by a strip 176. Flat section 172 is provided with a perpendicular flange 178, and flat section 174 is provided with a similar perpendicular flange 180. An elongated flange 182 extends from the upper end to the lower end of end member 166, and a guide flange 184 extends in perpendicular relationship to strip 176 from a point just below flat section 172 to a point just above flat section 174. End member 168 is identical to end member 166.

Panel 170 is generally rectangular in shape, and is provided, near its left-hand edge 186, with three rectangular slots 188, 190 and 192. Tabs 194, 196 and 198 are formed near the right-hand edge 200 of panel 170. It will be seen that the slots and tabs of panel 170 correspond to those seen on backing member 4 in FIG. 1, and enable panel 170 and backing member 164 to be secured together in exactly the same manner as the two backing members of FIG. 1 are secured together, that is by a relative sliding motion.

End members 166 and 168 are secured to the assembly comprising backing member 164 and panel 170 by means of a cooperating locking projections and slots. Two locking projections 202 and 204 on flange 178 cooperate with slots 206 and 208 roll retainer 210 of backing member 164. Similar locking projections on flanges 180, 212 and 214 cooperate with slots provided on backing member 164. The elongated flanges of the end members are also provided with inwardly projecting locking projections, which cooperate with slots provided along the vertical edges of panel 170. For example, locking projections 216 and 218 on elongated flange 182 cooperate respectively with slots 220 and 222 along vertical edge 200 of panel 170. It will be noted that projections 216 and 218, and slots 220 and 222 are positioned so as to avoid interference with the central rectangular panel 224 of backing member 164 and with depending flange 226 of roll retainer 210.

Similar locking projections 228 and 230 are provided near the lower end of flange 182 for cooperation with slots 232 and 234. Again, the projections and slots are positioned so as to avoid interference with backing member 164. End member 168 is identical to end member 166, a nd is secured to backing member 164 and panel 170 in a similar manner.

The result of the assembly of the four elements of FIG. 6 is shown in FIG. 7. The display comprises only three indicia-carrying sheets, and is adapted to be viewed from only one side. Panel 170 provides substantially all of the strength necessary to reinforce backing member 164. While the end members do stiffen the assembly somewhat, they function here primarily as end closures and as guides rather than as structural members.

As seen in FIG. 8, indicia-carrying sheet 236 is guided between guide flange 238 and punched out guide 240. Sheet 242 is similarly guided between punched out guides 244 and 246, and sheet 248 is guided between punched out guide 250 and guide flange 184.

Figure 9:
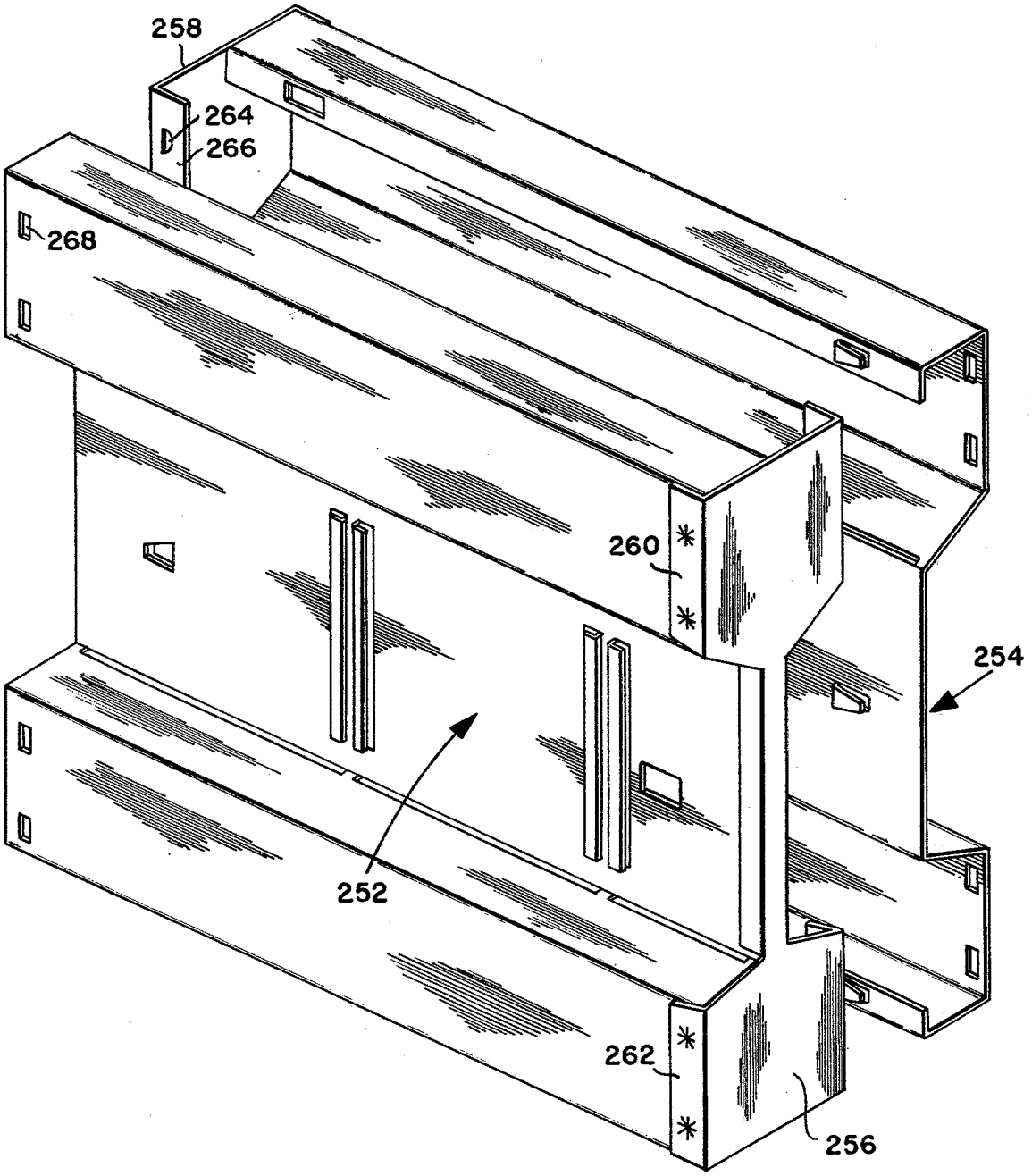
FIG. 9 is an exploded view of a further alternative support having only two separable parts.

The two-part support of FIG. 9 is similar in configuration to the support of FIG. 1, and comprises identical backing members 252 and 254, and identical end members 256 and 258.

The right-hand edges of the upper and lower roll retainers of backing member 252 are unslotted, and flanges 260 and 262 of end member 256 have no locking projections. Flanges 260 and 262 are spot welded to the upper and lower roll retainers of backing member 252 to provide a permanent connection between backing member 252 and end member 256. End member 258 is similarly connected by spot welding to the left-hand edge of backing member 254.

By virtue of the spot welding, it will be seen that each end member is permanently connected to one of the backing members, so that the support comprises only two separable pieces. The two separable pieces of the support are assembled by a relative sliding movement to engage the various tabs and slots of the backing members and to engage the locking projections on the remaining flanges of the end members (e.g. locking projection 264 on flange 266) with corresponding slots (e.g. slot 268) on the roll retainers of the backing members.

The support depicted in FIG. 9 is particularly easy to assemble, as it comprises only two separable parts. The permanent interconnection between the backing members and end members also contributes to the simplification of the painting process, as each of the two separable elements in FIG. 9 can be painted as a unit. While the formation of the assembly of FIG. 9 requires additional welding steps, the resulting simplification of the painting process reduces the overall time required for fabrication.

Each of the three supports described herein can be mounted in a number of ways. Small versions of the support can be bolted, for example, to the tops of gasoline pumps in order to provide a display which is highly visable to service station customers. The displays can also be hung, either individually or one above another, by chains from cross arms on service station light poles or from any other convenient support. Various other modes of support will occur to those skilled in the art.

While three specific versions of the support have been specifically disclosed in detail, the disclosure herein will suggest various other modifications which can be made without departing from the scope of the invention as defined in the following claims.

I claim:

1. A support for use in a movable indicia display in conjunction with self-coiling indicia-carrying sheets of the type comprising an elongated rectangular sheet of self-coiling material coiled at both of its ends whereby each sheet comprises a pair of rolls connected by a substantially planar section, comprising:

first and second substantially identical sheet metal members each having a substantially rectangular planar face on one side thereof and a back on its opposite side, each member having roll retaining means integrally formed on two opposite edges of the face thereof for holding the rolls of a sheet of self-coiling material in spaced relationship to each other, and guide means integrally connected to its face and extending in perpendicular relation to said opposite edges, said guide means comprising a pair of elongated, rectangular, punched-out sheet metal sections lying in a plane spaced from said face, said sections having elongated openings facing in opposite directions and adapted to receive the adjacent edges of a pair of side-by-side coplanar indicia-carrying sheets;

means for storing said first and second members together in back-to-back relationship; and a pair of end members, each end member being secured to all four of said roll retaining means, and at least one of said end members having means, extending between the opposite ends thereof, for forming guide channels for the edges of a pair of indicia-carrying sheets on opposite sides of the support;

said first and second members being secured together in back-to-back relationship at least in part by slot and tab means.

2. A display according to claim 1 in which said first and second members are secured together in back-to-back relationship at least in part by tab means formed on each of said first and second members in the part thereof behind its rectangular face, cooperating with slot means formed in the other of said first and second members.

3. A display according to claim 1 in which said first and second members are secured together in back-to-back relationship in part by tab means formed on each of said first and second members in the part thereof behind its rectangular face, cooperating with slot means formed in the other of said first and second members, and in part by tab means formed on the roll retaining means of each member cooperating with slot means formed in the roll retaining means of the other member.

4. A support for use in a movable indicia display in conjunction with self-coiling indicia-carrying sheets of the type comprising an elongated rectangular sheet of self-coiling material coiled at both of its ends whereby each sheet comprises a pair of rolls connected by a substantially planar section comprising:

first and second substantially identical sheet metal members, each member having a substantially rectangular planar face on one side thereof and a back on its opposite side, guide means integrally connected to said face, said guide means comprising a first elongated, rectangular, punched-out sheet metal section lying in a plane spaced from said face and having a first elongated opening facing one of two opposite edges of said face and adapted to receive one edge of an indicia-carrying sheet, and a second elongated, rectangular, punched-out sheet metal section lying in a plane spaced from said face and having a second elongated opening facing the other of said two opposite edges of said face and adapted to receive one edge of a second indicia-carrying sheet, and roll retaining means integrally formed on each of the two remaining edges of said face for holding the rolls of a sheet of self-coiling material in spaced relationship to each other, each roll retaining means being connected to its corresponding edge of said face by means of a series of narrow strips, and each roll retaining means being spaced from its corresponding edge of said face to provide a series of slots between said narrow strips for receiving said indicia-carrying sheets, said first and second members being arranged in back-to-back relationship with each of said two opposite edges of each face being located adjacent one of said two opposite edges of the other face and with each of the roll retaining means on each member being located adjacent one of the roll retaining means on the other member; and first and second substantially identical sheet metal end members, each end member having first means at one end thereof for securing the adjacent ends of a first pair of roll retaining means together, second means at the other end thereof for securing the adjacent ends of a second pair of roll retaining means together, and means providing an elongated integral interconnection between said first and second means, said interconnection-providing means also having means for cooperating with two adjacent edges of the faces of said first and second sheet metal members to provide guide channels for the edges of a pair of indicia-carrying sheets on opposite sides of the support;

said first and second members being secured together in back-to-back relationship at least in part by slot and tab means.

5. A support according to claim 4 in which said first and second members are secured together in back-to-back relationship at least in part by tab means formed on each of said first and second members in the part thereof behind its rectangular face, cooperating with slot means formed in the other of said first and second members.

6. A support according to claim 4 in which said first and second members are secured together in back-to-back relationship in part by tab means formed on each of said first and second members in the part thereof behind its rectangular face, cooperating with slot means formed in the other of said first and second members, and in part by tab means formed on the roll retaining means of each member cooperating with slot means formed in the roll retaining means of the other member.

7. A support according to claim 4 in which the first and second means of each end member are secured to said roll retaining means by cooperating slots and locking projections.

8. A support according to claim 4 in which one end member is permanently secured to said first sheet metal member, and the other end member is permanently secured to the second sheet metal member.

9. A movable indicia display comprising at least two self-coiling indicia-carrying sheets each of said sheets being formed into coils at opposite ends thereof and the coils of each sheet being spaced from each other to expose a portion of the sheet extending between the coils as a viewable portion, a first sheet metal member having a face, on one side thereof, adapted to serve as a backing for a viewable portion of one of said sheets, and a back on the opposite side thereof, said face being delineated in part by a pair of folds formed in said sheet metal member, said folds being spaced from and substantially parallel to each other, said sheet metal member also having a pair of coil-retaining portions extending forwardly from the respective folds and being unitary with said face, each coil-retaining portion having at least one narrow, elongated slot formed therein, with one long edge of each slot spaced forwardly from said face, and each slot extending, in the direction transverse to the direction of its elongation, at least to the approximate location of said face, a second sheet metal member substantially identical to, and arranged in back-to-back relationship with, said first sheet metal member, and having means connecting each coil-retaining portion of said first sheet metal member with a coil-retaining portion of said second sheet metal member, said connecting means, together with said coil-retaining portions, forming enclosures for coils formed at the ends of indicia-carrying self-coiling sheets, and reinforcing means for maintaining said forwardly-extending coil-retaining portions of said sheet metal members in substantially fixed relationship to their faces, wherein the viewable portion of one of said self-coiling sheets extends in substantially parallel relationship to the face of said first sheet metal member and its coils are located on the sides of the forwardly-extending coil-retaining portions of said first sheet metal member remote from its face, and wherein the viewable portion of another of said self-coiling sheets extends in substantially parallel relationship to the face of said second sheet metal member and its coils are located on the sides of the forwardly-extending coil-retaining portions of said second sheet metal member remote from its face.

* * * * *

UNITED STATES PATENT AND TRADEMARK OFFICE

CERTIFICATE OF CORRECTION

PATENT NO. : 4,195,430

DATED : April 1, 1980

INVENTOR(S) : James M. Suttles

It is certified that error appears in the above-identified patent and that said Letters Patent are hereby corrected as shown below:

Column 3, line 5 "and" should be inserted after "with".

Column 7, line 1 "a" should be deleted.

Column 7, line 22 "a nd" should be "and".

Column 8, line 40 "storing" should be "securing".

Signed and Sealed this

Tenth Day of June 1980

[SEAL]

Attest:

SIDNEY A. DIAMOND

Attesting Officer

Commissioner of Patents and Trademarks